US005637953A

United States Patent [19]

Wakalopulos

[11] Patent Number: 5,637,953

[45] Date of Patent: Jun. 10, 1997

[54] CATHODE ASSEMBLY FOR A LINE FOCUS ELECTRON BEAM DEVICE

[75] Inventor: George Wakalopulos, Pacific Palisades, Calif.

[73] Assignee: American International Technologies, Inc., Torrance, Calif.

[21] Appl. No.: 589,265

[22] Filed: Jan. 22, 1996

[51] Int. Cl.[6] ..... H01J 29/70; H01J 29/58

[52] U.S. Cl. ..... 313/421; 313/420; 313/426; 313/422

[58] Field of Search ..... 313/420, 421, 313/452, 425, 441, 444, 426, 239, 348, 349, 352, 422

[56] References Cited

U.S. PATENT DOCUMENTS

| | | | |
|---|---|---|---|
| 3,609,401 | 9/1971 | Harris et al. | 313/82 |
| 3,611,418 | 10/1971 | Uno et al. | 346/74 ES |
| 3,788,892 | 1/1974 | Van Raalte et al. | 117/212 |
| 4,468,282 | 8/1984 | Neukermans | 156/633 |
| 4,764,947 | 8/1988 | Lesensky | 378/138 |
| 5,414,267 | 5/1995 | Wakalopulos | 250/492.3 |

*Primary Examiner*—Sandra L. O'Shea
*Assistant Examiner*—Joseph Williams
*Attorney, Agent, or Firm*—Thomas Schneck

[57] ABSTRACT

An electron beam device has a cathode that generates a fan-shaped electron beam. A first focusing lens includes first and second plates on opposed sides of a filament. The edges of the plates closest to a positively charged anode are arcuate, so that as individual electrons are accelerated normal to the edge of the charged plates, the beam increases in length with departure from the filament. A second focusing lens includes third and fourth plates on opposed sides of the first focusing lens. Each of the third and fourth plates has an arcuate edge proximate to the positively charged anode. The plates of the first and second focusing lenses provide focusing in a widthwise direction, while defining the increase in the lengthwise direction. Preferably, the filament is also curved. In the preferred embodiment, the curvature of the plates of the first focusing lens defines a common radius with the plates of the second focusing lens. The electron beam may be projected from the interior of an evacuated tube and may have a length that is not limited by the length of the filament.

17 Claims, 3 Drawing Sheets

CATHODE ASSEMBLY FOR A LINE FOCUS ELECTRON BEAM DEVICE

TECHNICAL FIELD

The invention relates generally to an electron beam device and more particularly to a cathode assembly for generating an electron beam that is emitted from the electron beam device.

BACKGROUND ART

Vacuum tubes for providing a favorable atmosphere for generating and accelerating an electron beam are commonly used for such purposes as exciting areas on a phosphorescent screen to allow television viewing. Typically, the electron beam that is generated within a vacuum tube is confined within the tube. However, in some applications it may be desirable to emit the beam from the vacuum tube for treatment of surfaces.

U.S. Pat. No. 5,414,267 to Wakalopulos, which is assigned to the assignee of the present invention, describes an electron beam tube that projects a stripe-like beam through a window of the vacuum tube. The beam may then be used for radiation chemistry, such as surface treatment of materials or curing of adhesives. Electrons are generated at a linear filament that is a thermionic electron emitter. A beam-forming electrode having a shape of a parabolic cylinder defines the beam as it is driven from the linear filament. The stripe-like beam is directed to an anode to project the beam through the window.

An array of electron beam devices of the type described in Wakalopulos may be arranged so that the resulting array of stripe-like electron beams cooperates to treat a wide surface. The patent teaches that a practical length of a beam emitted by such a device is in the range of 1–3 inches (25.4–76.2 mm). At the high end of this range, the thermionic filament must have a length of 76.2 mm. This would require a relatively large vacuum tube body.

U.S. Pat. No. 4,764,947 to Lesensky also teaches a tube that emits a stripe-like beam. A filament having a length corresponding to the desired length of the beam is held at the same electrical potential as a first focusing cup. A second focusing cup that is between the filament and the first focusing cup has a higher negative electrical potential than the first focusing cup. With this arrangement, undesired electron emission from selected portions of the filament are suppressed. Specifically, electron emission from the side and rear portions of the filament are suppressed, thereby substantially eliminating B-distribution from the electron distribution of the focal spot produced by the electron beam. The x-ray tube of Lesensky projects a beam having a length that corresponds to the length of the filament.

In comparison, U.S. Pat. No. 3,609,401 to Harris et al. describes an electron gun that transforms a beam of electrons having a circular cross section into a sheet beam. Electrons are emitted from a filament toward a first anode having a circular central aperture. The beam that passes through the first anode is generally circular in cross section. A pair of electrodes are on opposed sides of the circular beam. The electrodes combine to define an ellipse having open ends at the long dimension. The elliptical arrangement provides a focusing action along the short dimension, but the beam diverges in the long dimension. The patent describes the resulting beam as having a flat shape resembling an ax blade. Thus, the nonsymmetrical focusing field established by the electrodes alters the shape of the electron beam from a circular cross section as it passes through the aperture in the first electrode to a substantially rectangular cross section as it passes through the second electrode. The invention may be used for electron probe microanalysis. While the electron gun of Harris et al. operates properly for many applications, a concern is that by allowing the beam to be left free to diverge in long dimension, the resulting beam does not possess the necessary characteristics for precision treatment of surfaces.

An object of the invention is to provide an electron beam device in which a generated beam has a controlled beam length that is substantially greater than a controlled beam width.

SUMMARY OF THE INVENTION

The above object has been met by an electron beam device having a cathode that includes inner and outer plates that cooperate with an arcuate region of a filament to provide an electron beam that increases in length with distance from the filament. The arcuate region of the filament emits a fan-shaped beam toward an anode. The edges of the plates are configured to maintain the shape of the electron beam, but the remainder of the design of the plates focuses the beam with respect to the widthwise direction. Because the electron beam increases in length with distance from the filament, a desired beam length can be achieved without requirement that the device include a filament of the same length.

In the preferred embodiment, the filament has a curvature that defines the initial shape of the electron beam. The inner pair of plates acts as a first focusing lens, with a first and second plate on opposed sides of the filament. The inner plates are negatively charged to provide focusing of the electrons emitted from the filament toward a positively charged anode. The first and second plates extend generally along the lengthwise direction of the emitted electron beam, but may have some curvature. The edges of the plates closest to the anode are arcuate. These edges further define the shape of the electron beam. Since the individual electrons within the beam are generally driven at the normal to the edge, the arcuate edges of the inner plate promote the fan shape of the electron beam.

The outer plates are third and fourth plates that act as a second focusing lens. The third and fourth plates are on opposed sides of the first focusing lens. In the preferred embodiment, the third and fourth plates are arcuate at edges closest to the anode. Such arcuate edges further promote the fan shape of the electron beam. Tailoring of the beam is also permitted by providing a means for adjusting the distance between the third and fourth plates, and consequently the distance of each outer plate from the filament and from each of the first and second plates. Adjusting the positions of the outer plates will vary the focus of the electron beam in the widthwise direction.

The first, second, third and fourth plates may be parallel to each other and to the filament. However, if a flat anode is used, electrons will travel varying distances from the filament to the anode, depending upon the position of electrons within the fan shape. Consequently, it may be desirable to curve the plates in a manner to provide greater acceleration with departure from the apex of the fan-shaped beam.

The electron beam device includes a window that permits the beam to be projected from the evacuated body of the device. The projected beam may be used either in isolation or in combination with other electron beam devices to treat surfaces or to cure adhesive. In order to restrict the length of an electron beam of a device, a filament-cover member having a beam aperture may be fixed at the filament level to prevent electron emission from occurring along the entire length of a filament.

While not critical, different electrical potentials may be established at the two plates of one or both of the pairs of plates. For example, the selection of electrical potentials at the third and fourth plates may be used as a steering mechanism for aligning beam projection with the beam window of the device. In one embodiment, the third and fourth plates are isolated from each other and are connected to separate bias supplies. In a passive embodiment, a bias supply is connected to the third plate, which is electrically connected to the fourth plate by one or more resistors that are selected to achieve beam alignment.

Beam steering and alignment can also be provided by forming a magnetic field along the beam path through the device. Manufacturing tolerances for components of the device can be relaxed to some extent by allowing individual devices to be fine tuned using one or more magnetic structures that are fixed in position after the desired beam alignment is achieved.

An advantage of the invention is that the length of a beam projected from an evacuated electron beam device is not limited to the length of a filament within the device. As a result, beams having a controlled length may be highly focused in a widthwise direction. The focusing in the widthwise direction is dependent upon the spacing between the plates and upon the electrical potential of the plates. In one embodiment, the inner and outer plates are electrically connected, so that the plates are at the same electrical potential. This simplifies the electrical connections to the interior of the evacuated device. However, in some applications it may be beneficial to establish different potentials for the inner and outer plates.

BEST MODE FOR CARRYING OUT THE INVENTION

Figure 1:
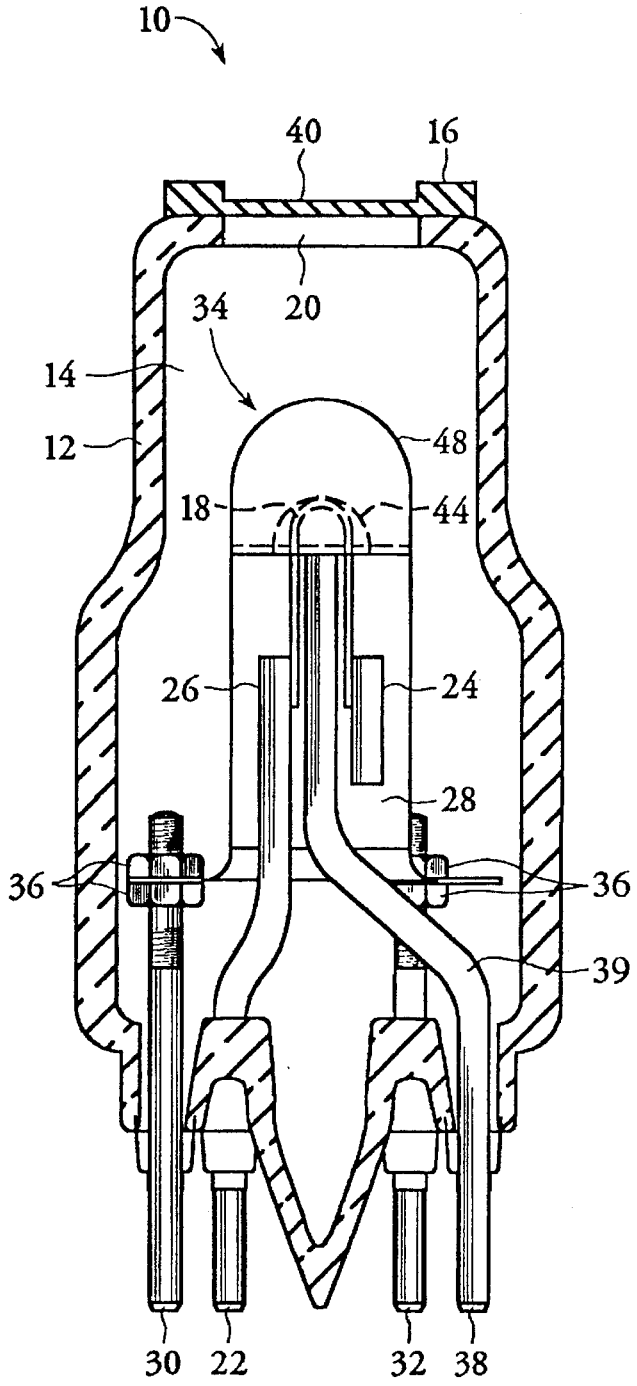
FIG. 1 is a cutaway side view of an electron beam device in accordance with the invention.

With reference to FIG. 1, an electron beam device 10 includes a tube body 12 that defines an evacuated chamber 14. The electron beam device is of the type that projects a beam beyond the interior of the tube body. The beam is released through a gas impermeable membrane 16. The membrane may be an n-type silicon wafer that serves as an anode that attracts electrons from a filament 18. Alternatively, a separate anode 20 may be included.

The filament 18 is centered within the tube body 12. The filament is a thermionic member that is maintained at a highly negative potential relative to the electrical potential of the anode 20. An acceptable potential difference between the filament and the anode is one that is within the range of −10 to −200 kilovolts. At a bottom side of the electron beam device 10 is an array of electrical pins. The pins function to provide mechanical support and electrical interconnection. A filament pin 22 and a second hidden pin are connected to the tube body 12 by means of a metal-to-glass seal or the like. The two pins connect to feed-through carrying electrodes 24 and 26. The electrodes connect within an electrically insulative block 28 to the filament 18 in order to generate electrons by thermionic emission.

Support pins 30 and 32 provide support for the insulative block 28, which supports a cathode assembly 34. The upper ends of the support pins are externally threaded to allow use of nuts 36 to achieve the desired mechanical support. However, with the exception of the cathode assembly 34, none of this structure is necessary to the use of the invention.

The cathode assembly 34 is used to accelerate electrons generated at the filament 18. The negative potential to the cathode assembly is applied to a cathode pin 38, which is attached to an electrode wire 39 by means of a connection not shown in FIG. 1. The membrane 16 includes a central window 40. The membrane is seated atop the tube body 12, but may be mounted to the inside of the tube body. A rectangular conductive frame, not shown, is joined to the window to allow a positive potential relative to the cathode assembly 34 to be applied to the electrode 20. This potential, which may be ground potential, attracts electrons from the filament 18. The conductive support frame connects to the periphery of the window, providing an electric field through the window that attracts electrons. Local ground potential is supplied by a mounting plate or by any convenient source. The tube body may be formed of glass or some other dielectric, allowing penetration of an electric field from the boundary of the window. The ground potential may be approximately 50 kilovolts positive relative to the electrode assembly, thereby establishing an electric field between the cathode assembly and the window. Because the window is electron permeable, electrons from the filament 18 project through the window. The conductive frame draws little current, since substantially all of the electrons pass through the window. The length of the tube may be approximately 15 cm, excluding the pins 22, 30, 32 and 38. The circumferential dimension of the tube body 12 may be 8 cm. However, none of these dimensions is critical.

One of the advantages of the tube design relative to other electron beam curing equipment is the ability to use relatively low beam voltages. A 50 kilovolt beam has little penetration power through polymers. Most of the beam energy is used for crosslinking and curing the polymer.

Figure 2:
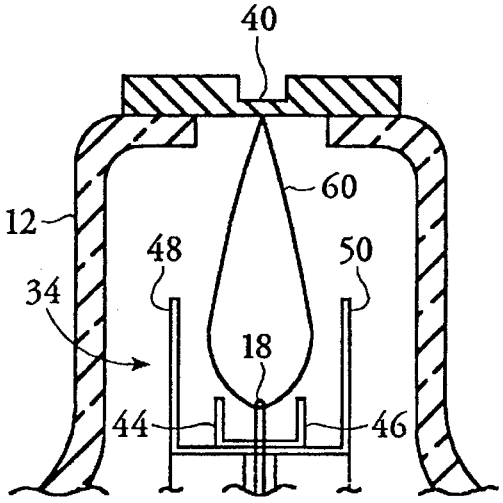
FIG. 2 is a cutaway side view of a top portion of the electron beam device, oriented normally to the view of FIG. 1.

Referring now to FIGS. 1 and 2, the cathode assembly 34 includes an inner pair of plates 44 and 46 and an outer pair of plates 48 and 50. The inner and outer plates cooperate to shape the electron beam. The filament 18 is arcuate, so that electrons traveling from the filament to the anode 20 will have a fan shape, i.e., will increase in length with departure from the filament. However, the filament assembly preferably includes a cover member having a beam aperture that exposes only a portion of the length of the filament. The beam aperture restricts the length of the beam. Because the inner plates are on opposed sides of the filament and are negatively charged, the plates will accelerate the emitted electrons. Individual electrons will be accelerated in a direction perpendicular to the upper edges of the inner plates 44 and 46. Because the upper edge is curved, the direction of perpendicularity will depend upon the position of individual electrons. Preferably, the curvature of the filament 18 corresponds to the curvature of the edges of the inner plates 46 and 48. Consequently, the emitted electron beam will continue to expand.

Figure 3:
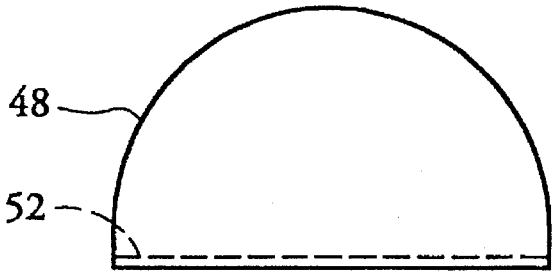
FIG. 3 is a side view of an outer focusing lens of FIG. 2.
Figure 4:
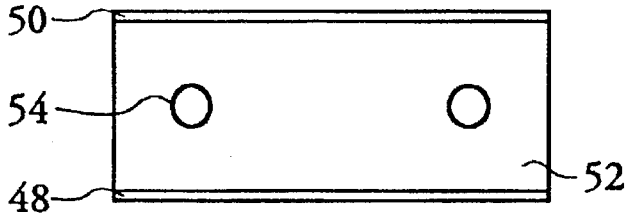
FIG. 4 is a top view of the focusing lens of FIG. 3.

The outer plates 48 and 50 also include arcuate upper edges. The plates are best seen in FIGS. 3 and 4. The height of outer plates may be 0.40 inch (10.16 mm). In one embodiment, each plate has a thickness of 0.01 inch (0.25 mm) and is formed of non-metallic stainless steel. The plates are connected by a base 52 having a pair of bores 54 for mounting the outer plates. The length of each plate may be 0.685 inch (17.4 mm).

Figure 5:
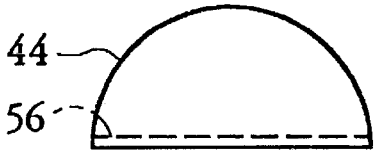
FIG. 5 is a side view of an inner focusing lens of FIG. 2.
Figure 6:
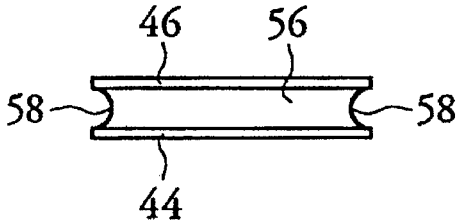
FIG. 6 is a top view of the focusing lens of FIG. 5.

The construction of the inner plates 44 and 46 is shown in FIGS. 5 and 6. In one embodiment, each inner plate has a height of 0.24 inch (6.09 mm) and has a thickness of 0.01 inch (0.254 mm). The plates and a base 56 that connects the plates are a unitary design of non-metallic stainless steel. At each end of the base is a cutaway 58 that can be aligned with the bores 54 of FIG. 4. In this manner, the outer plates 48 and 50 are electrically connected to the inner plates, ensuring that the four plates are held at the same electrical potential during operation of the electron beam device.

Referring to FIGS. 1–6, because each of the inner pair of plates 44 and 46 and the outer pair of plates 48 and 50 is open at opposed longitudinal ends, the beam emitted by the filament 18 will expand in the lengthwise direction in a manner controlled by the curvature of the filament 18 and the curvature of the upper edges of the plates. As previously noted, the assembly optimally includes a filament-cover member having a beam aperture that exposes only a set portion of the filament in order to limit the length of the beam that is controlled by the plates. Widthwise control of the electron beam is determined by a number of factors, including the relative positions and the relative potentials of the filament 18, the inner pair of plates and the outer pair of plates. In one embodiment, the inner plates 44 and 46 are spaced apart by 0.08 inch (2.03 mm) and are equidistantly spaced from the filament, while the outer plates are spaced apart by a distance of 0.25 inch (6.35 mm) and are equidistantly spaced from the filament. This embodiment will cause focusing of the electron beam in the widthwise direction, as shown schematically by lines 60 in FIG. 2. While the invention has been described as having the inner and outer plates at a single electrical potential, the focus in the widthwise direction may be further controlled by electrically isolating the inner plates from the outer plates and applying different voltages. Moreover, the plates may adjust in position with respect to the filament and to each other, thereby permitting adjustments in the control of the beam. For example, the outer plates may be connected in a manner that allows the outer plates to slide inwardly or outwardly.

As previously noted, the increase in the length of the emitted electron beam with departure from the filament 18 is controlled by the curvatures of the filament and the upper edges of the inner and outer plates 44, 46, 48 and 50. An individual electron within the beam will be accelerated at an angle normal to the localized regions of the plates. In the embodiment which has been discussed, the radius of the inner plates is 0.22 inch (5.59 mm) and the radius of the outer plates is 0.37 inch (9.4 mm). Preferably, the filament, the inner plates and the outer plates all define a common axis. However, this is not critical. In fact, a fan-shaped beam may be formed if the filament is linear, since the arcuate edges of the plates will define a fan shape.

Figure 7:
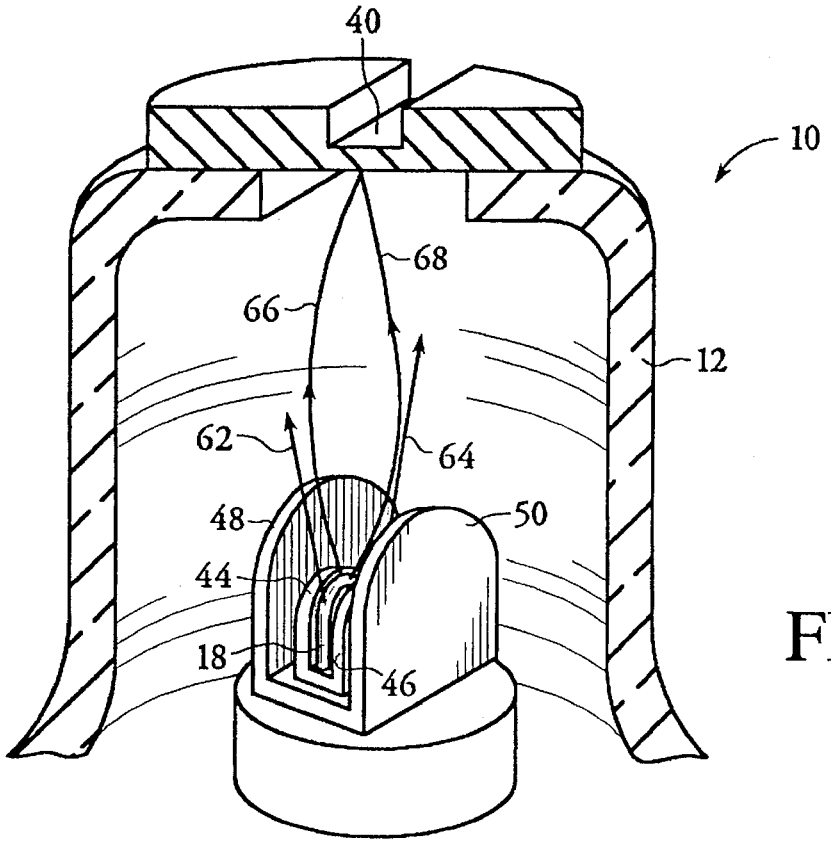
FIG. 7 is a cutaway perspective view of the electron beam device of FIG. 1.

In operation, the filament 18 generates and emits electrons in the direction of a window 40, as shown in FIG. 7. The plates 44, 46, 48 and 50 are open ended. Consequently, the electron beam from the filament is allowed to expand in the lengthwise direction, as shown by the paths of exemplary electrons 62 and 64. On the other hand, the beam is focused in the widthwise direction, as shown by exemplary electrons 66 and 68. A fan-shaped beam is formed. The shape of the beam allows the electron beam device 10 to project a beam having a length greater than the length of the filament within the tube body 12. A desired surface treatment area can be obtained without the requirement that the filament have a length comparable to the length of the treatment beam.

Figure 8:
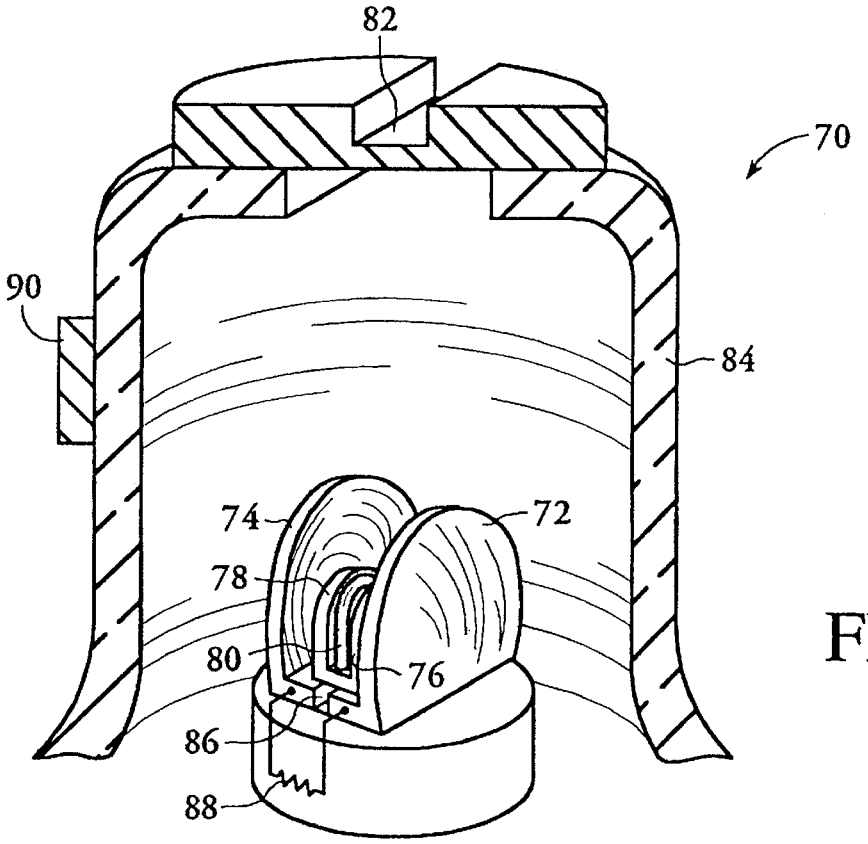
FIG. 8 is a cutaway perspective view of a second embodiment of an electron beam device in accordance with the invention.

In the embodiment set forth above, the positively charged anode is planar. Thus, the electrons at the opposed lengthwise ends of the generated electron beams must travel a greater distance than the electron beams at or near the center of the beam. In some applications, it may be beneficial to provide a curved anode that equalizes the electron travel. Alternatively, the inner and/or outer plates 44, 46, 48 and 50 may be configured to provide a greater degree of electron acceleration with departure from the center of the beam. Referring now to FIG. 8, an electron beam device 70 is shown as having outer plates 72 and 74 that are curved not only at the upper edge, but also along the major surfaces. That is, the outer plates have a maximum distance from inner plates 76 and 78 at the center of the plates, and decrease in distance from the inner plates with departure from the centers. The resulting electrical field provides greater acceleration at the lengthwise ends of the fan-shaped electron beam than at the center of the beam. Electrons generated at a filament 80 are projected through a window 82 from the evacuated chamber of a tube body 84. The configuration of the outer plates 72 and 74 better focuses the beam onto the positively charged anode of the device 70.

In the embodiment of FIG. 8, the outer plates 72 and 74 are electrically isolated from each other by an insulative member 86. The electrical isolation permits a degree of beam steering. By selecting the proper relationship of potentials at the plates, the electron beam can be aligned to impinge the window 82, as required. A resistor 88 or a resistor network may be employed to establish the desired relationship of bias voltages. This passive embodiment requires a single connection to an external source of a bias voltage. In an active embodiment, the plates are connected to separate sources. The active embodiment facilitates alignment adjustments on a device-by-device basis.

An optional magnetic member 90 is also shown in FIG. 8. The magnetic member has a magnetic field that extends into the electron beam path to the window 82. One or more such magnetic members are fixed to the side of the device 70 as needed to properly align beam projection with the window. The positioning may vary among devices, since there are likely to be variations in the manufacture and assembly of device components. Consequently, use of the magnetic members allows a relaxation of manufacturing tolerances.

I claim:

1. An electron beam device comprising:

a gas impermeable body defining an evacuated chamber;

filament means located within said evacuated chamber for generating an electron beam having a beam length and a beam width, said filament means thereby defining lengthwise and widthwise directions within said evacuated chamber;

anode means positioned relative to said filament means for attracting said electron beam to define a beam path within said evacuated chamber;

a first focusing lens having first and second plates on opposed sides of said filament means, each of said first and second plates being arcuate along an edge proximate to said anode means; and a second focusing lens having third and fourth plates on opposed sides of said first focusing lens, each of said third and fourth plates being arcuate along an edge proximate to said anode means, said second focusing lens extending beyond said first focusing lens in the direction from filament means to said anode means.

2. The device of claim 1 wherein said first, second, third and fourth plates are planar and are substantially parallel to each other.

3. The device of claim 1 wherein each of said first, second, third and fourth plates has a semicircular shape.

4. The device of claim 1 wherein said arcuate edges of said first, second, third and fourth plates define a common axis.

5. The device of claim 4 wherein said filament means includes an arcuate filament such that said electron beam is fan-shaped, said arcuate filament having a curvature to define said common axis.

6. The device of claim 1 wherein said first, second, third and fourth plates are physically spaced apart and are electrically connected together.

7. The device of claim 1 further comprising an electron window connected to said body positioned relative to said anode to permit passage of said electron beam through said electron window.

8. An electron beam emitting device comprising:

an evacuate tube having a gas-impermeable, electron-permeable window for emission of an electron beam having a beam length that is greater than a beam width;

an arcuate filament for generating electrons within said evacuated tube;

an anode positioned within said evacuated tube to direct electrons from said arcuate filament to said window;

cathode means having inner and outer pairs of plates for propagating a fan-shaped electron beam from said arcuate filament to said anode, said inner pair of plates being first and second plates on opposed sides of said arcuate filament, said outer pair of plates being third and fourth plates on opposed sides of said inner pair of plates, each of said plates having a fan-shaped edge region for propagating said fan-shaped electron beam.

9. The device of claim 8 wherein said fan-shaped edge regions of each of said plates define a common axis.

10. The device of claim 9 wherein said fan-shaped edge regions of said outer plates define a first radius greater than a second radius defined by said fan-shaped regions of said inner plates.

11. The device of claim 8 wherein said plates are in a parallel relationship.

12. The device of claim 9 wherein said arcuate filament has a curvature that further defines said common axis.

13. The device of claim 8 wherein said inner and outer plates are connected to remain at an equal electrical potential.

14. A cathode of an electron beam device for generating an electron beam having a greater length than a width comprising:

a filament having an arcuate region for emitting an electron beam having a shape of a fan, with lengthwise and widthwise directions;

generally parallel first and second inner plates on opposite sides of said filament, said inner plates extending generally in said lengthwise direction and having a first height that is perpendicular to said lengthwise and widthwise directions; and generally parallel third and fourth outer plates on opposite sides of said inner plates, said outer plates being generally parallel to said inner plates and having a second height that is perpendicular to said lengthwise and widthwise directions and that is greater than said first height;

wherein each of said inner and outer plates has an arcuate edge at an upper extent to define said first and second heights, said arcuate edges of said inner and outer plates being aligned.

15. The cathode of claim 14 wherein said arcuate edge of said filament has a third height that is aligned with said arcuate edges of said inner and outer plates such that said upper extent of said filament and said inner and outer plates are aligned in said widthwise direction.

16. The cathode of claim 14 wherein said inner and outer plates are electrically connected.

17. The cathode of claim 14 wherein each of said inner and outer plates has a semicircular shape.

* * * * *